US006487777B1

(12) United States Patent
Yamane et al.

(10) Patent No.: US 6,487,777 B1
(45) Date of Patent: Dec. 3, 2002

(54) CUTTING BLADE COVER

(75) Inventors: Yoshiro Yamane, Akashi (JP); Tadao Yashirodai, Kakogawa (JP); Kazuhiko Takemoto, Kakogawa (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 65 days.

(21) Appl. No.: 09/714,474

(22) Filed: Nov. 16, 2000

(30) Foreign Application Priority Data

Nov. 24, 1999 (JP) ..... 11-332988

(51) Int. Cl.[7] ..... B26B 3/06; B26B 29/02; F41B 13/04

(52) U.S. Cl. ..... 30/162; 30/151; 224/232

(58) Field of Search ..... 30/286, 514, 308.1, 30/308.2, 151, 162; 224/323

(56) References Cited

U.S. PATENT DOCUMENTS

| | | | | | |
|---|---|---|---|---|---|
| 144,177 | A | * | 10/1873 | Williams | 30/233 |
| 978,387 | A | * | 12/1910 | Matthey | 30/151 |
| 1,258,481 | A | * | 3/1918 | Shobar | 30/167 |
| 1,576,682 | A | * | 3/1926 | Stapp | 30/168 |
| 1,593,935 | A | * | 7/1926 | Gerick et al. | 206/349 |
| 1,969,677 | A | * | 8/1934 | Stowell | 224/247 |
| 2,524,110 | A | * | 10/1950 | Kuemmerling | 30/514 |
| 2,544,479 | A | * | 3/1951 | Zengel | 132/73.5 |
| 2,687,833 | A | * | 8/1954 | Sutton | 224/232 |
| 2,775,275 | A | * | 12/1956 | Forbes | 30/167 |
| 2,779,367 | A | * | 1/1957 | Forbes | 30/167 |
| 2,859,516 | A | * | 11/1958 | McQueary | 30/151 |
| 2,867,363 | A | * | 1/1959 | Kuemmerling | 206/349 |
| 3,307,756 | A | * | 3/1967 | Brunosson et al. | 224/232 |
| 3,637,120 | A | * | 1/1972 | Clay | 219/242 |
| 4,307,825 | A | * | 12/1981 | Pattermann | 224/231 |
| 4,817,738 | A | | 4/1989 | Dorner et al. | |
| 4,828,154 | A | * | 5/1989 | Clifton, Jr. | 224/192 |
| 5,232,136 | A | * | 8/1993 | Unger | 224/247 |
| D403,150 | S | * | 12/1998 | Diener et al. | D3/228 |
| 6,076,261 | A | * | 6/2000 | Eriksson et al. | 206/349 |
| D455,900 | S | * | 4/2002 | Tecson | D3/228 |

FOREIGN PATENT DOCUMENTS

| | | | | |
|---|---|---|---|---|
| FR | 1190233 | * | 3/1959 | 30/286 |
| JP | 53 77497 | | 11/1951 | |
| JP | 63-56213 | | 3/1988 | |
| JP | 4-52862 | | 5/1992 | |
| JP | 7-18531 | | 7/1995 | |
| JP | 09 166053 | | 6/1997 | |

* cited by examiner

*Primary Examiner*—M. Rachuba
*Assistant Examiner*—Jason Prone
(74) *Attorney, Agent, or Firm*—Oppenheimer Wolff & Donnelly LLP

(57) ABSTRACT

A cutting blade cover(10) is used for protecting a cutting blade(11) having a shank member(16) connected to a driving unit of a reaper and a plate-shaped blade member(17) continuous with the shank member(16) and provided with a cutting portion(18) at a tip portion thereof that is orthogonal to the shank member(16). The cutting blade cover(10) comprises a bag-shaped accommodating portion(24) for accommodating the cutting portion(18) provided at the tip portion of the plate-shaped blade member(17) and a shank retaining portion(25) for retaining the shank member(16).

10 Claims, 6 Drawing Sheets

CUTTING BLADE COVER

BACKGROUND OF THE INVENTION

1. Field of the Invention

The present invention relates to a cover for a cutting blade used for a reaper in which a cutting blade reciprocates.

2. Description of the Related Art

Conventionally, as shown in FIG. 9, a hand-held brush cutter 100 provided with an engine 101 mounted at one end thereof and a disk-shaped cutter 102 at the other end thereof that is rotated to cut bushes and the like has been used.

Recently, as shown in FIGS. 7 and 8, there has been proposed a hand-held reaper 12 comprising an engine 13 at a rear end thereof and a cutting blade 11 at a forward end thereof that reciprocates, as a power driven reaper for cutting off nuts or branches that cannot be handled by the brush cutter 100. The cutting blade 11 is constituted by a bar-shaped shank member 16 attached to a driving unit. 15 of the reaper 12 and a plate-shaped blade member 17 integral with the shank member 16 and having a cutting portion 18 at a tip end thereof that is orthogonal to the shank member 16.

While a variety of cutter covers are used for protecting disc-shaped cutters in the brush cutter (see FIG. 1 of Japanese Laid-Open Patent Publication No. Sho 63-56213), there is a need for a protection cover suitable for a cutting blade for a power driven reaper that has a shank member at a base end thereof and a cutting portion at a tip end thereof.

SUMMARY OF THE INVENTION

In consideration of above-mentioned circumstances, it is an object of the invention to provide a cutting blade cover for a cutting blade of a reciprocating type that is easily attachable and detachable, is highly retentive, and is fabricated at a low cost.

In one aspect of the invention, a cutting blade cover for protecting a cutting blade constituted by a shank member connected to a driving unit of a reaper and a plate-shaped blade member formed continuously with the shank member and having a cutting portion at a tip portion thereof that is orthogonal to the shank member, comprises: a bag-shaped accommodating portion for accommodating the cutting portion provided at the tip portion of the plate-shaped blade member; and a shank retaining portion for retaining the shank member.

According to the cutting blade cover described above, the cutting portion at the tip end is covered and protected and the tip portion is retained by the bag-shaped accommodating portion, and the rearward shank member is retained by the shank retaining portion integral with the bag-shaped accommodating portion. Therefore, the cover is easily attachable and detachable and is highly retentive.

In another aspect of the invention, the cutting blade cover further comprises an elastic portion that is formed continuously with a tip portion of the bag-shaped accommodating portion and is elastically deformed when an external force is applied to the bag-shaped accommodating portion.

According to the cutting blade cover described above, since the elastic portion is provided at the tip end of the bag-shaped accommodating portion for accommodating the cutting portion, the external force applied to the tip portion of the cutting blade is relieved due to the elastic portion. Therefore, protective effect for the tip portion of the cutting blade is further enhanced, and the cutting blade cover itself is protected. Furthermore, because only the extension of the tip of the bag-shaped accommodating portion provides the elastic portion without a substantial increase in weight and cost, this cutting blade cover is suitable as a protection cover of this type.

In still another aspect of the invention, the cutting blade cover further comprises a first displacement restricting portion provided between the bag-shaped accommodating portion and the shank retaining portion, for supporting a base end portion of the plate-shaped blade member and the shank member so as to restrict displacement of the cutting blade from the bag-shaped accommodating portion.

According to the cutting blade cover described above, the first displacement restricting portion serves to restrict axial movement of the cutting blade.

In a further aspect of the invention, the cutting blade cover further comprises a base plate portion covering a side surface of the plate-shaped blade member, the bag-shaped accommodating portion and the shank retaining portion being provided on the base plate portion; and a second displacement restricting portion provided along a rear peripheral portion of the base plate portion, for supporting a base end portion of the plate-shaped blade member of the cutting blade so as to restrict displacement of the cutting blade from the bag-shaped accommodating portion.

According to the cutting blade cover described above, movement of the cutting blade as large as the base plate portion is restricted by the second displacement restricting portion.

It is preferable that the bag-shaped accommodating portion and the shank retaining portion are formed of synthetic resin integrally with the base plate portion covering the side surface of the plate-shaped blade member.

According to the cutting blade cover having such a structure, the cutting blade cover can be fabricated easily and at a lower cost.

It is preferable that the bag-shaped accommodating portion includes a ridge-shaped retaining portion extending in a direction of the shank to sandwich and securely retain a tip portion of the cutting blade with the cutting portion of the cutting blade accommodated in the bag-shaped accommodating portion.

According to the cutting blade cover having such a structure, the retaining portion serves to sandwich and securely retain the tip portion and the play of the tip portion is thereby avoided. In addition, since the retaining portion is ridge-shaped and partially formed in the bag-shaped accommodating portion in the direction of the shank, it is easy to make a spacing of the retaining portion smaller to be adapted to the plate-shaped blade member having a relatively small thickness.

These objects as well as other objects, features and advantages of the invention will become more apparent to those skilled in the art from the following description with reference to the accompanying drawings.

DETAILED DESCRIPTION OF THE PREFERRED EMBODIMENT

An embodiment of the invention will be described below with reference to the drawings.

Figure 1:
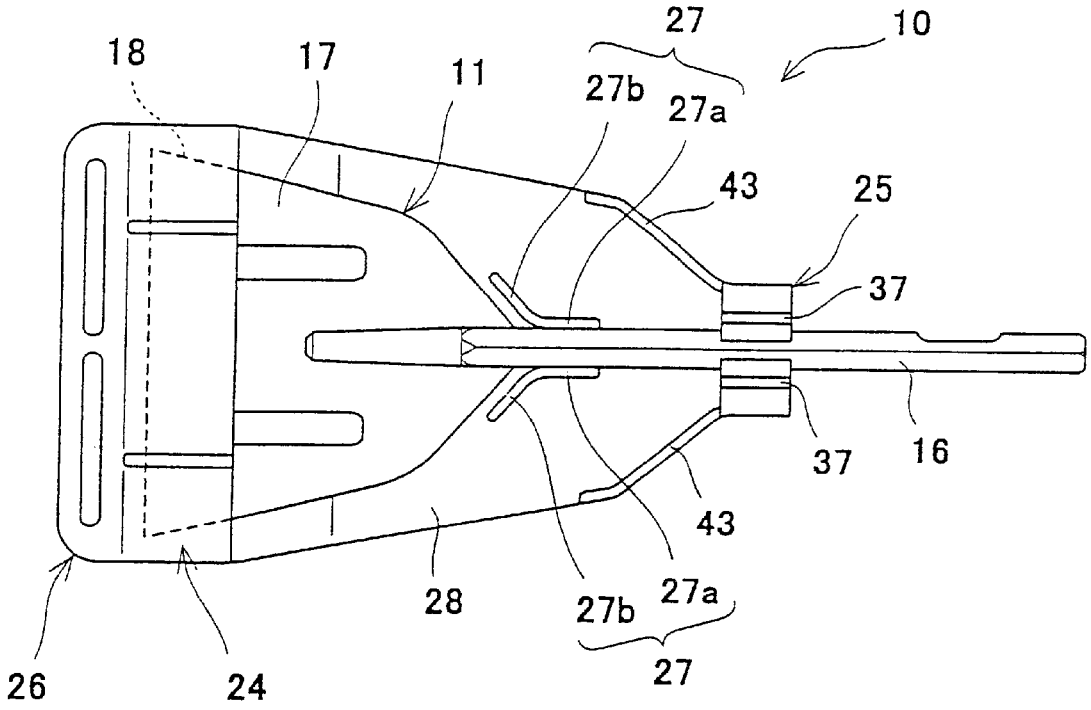
FIG. 1 is a plan view of a cutting blade cover according to an embodiment of the present invention, showing a state in which the cutting blade cover is attached to the cutting blade.
Figure 2:
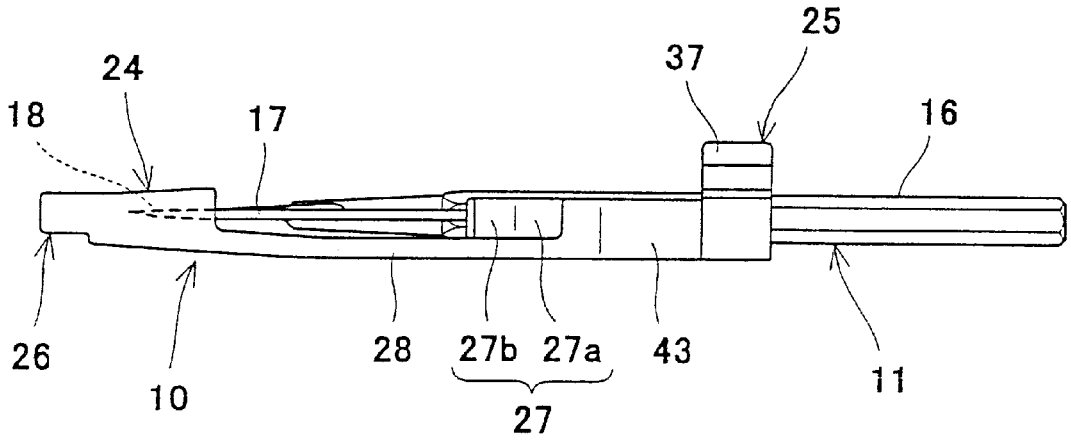
FIG. 2 is a side view of the cutting blade cover of FIG. 1, and showing a state in which the cutting blade cover is attached to the cutting blade.

FIGS. 1 and 2 are views showing a structure of a cutting blade cover according to the embodiment of the present invention, and showing a state in which a cutting blade cover 10 is attached to a cutting blade 11.

With reference to FIGS. 1 and 2, the cutting blade cover 10 will be described.

The cutting blade cover 10 comprises a bag-shaped accommodating portion 24 for accommodating a tip portion including a cutting portion 18 of the cutting blade 11, a shank retaining portion 25 for retaining a shank member 16 of the cutting blade 11, an elastic portion 26 formed continuously with a tip portion of the bag-shaped accommodating portion 24, restricting plates 27 as a first displacement restricting portion for restricting displacement of the cutting blade 11, edge plates 43 as a second displacement restricting portion, and a flat base plate portion 28 which makes connection of the above portions.

Figure 3:
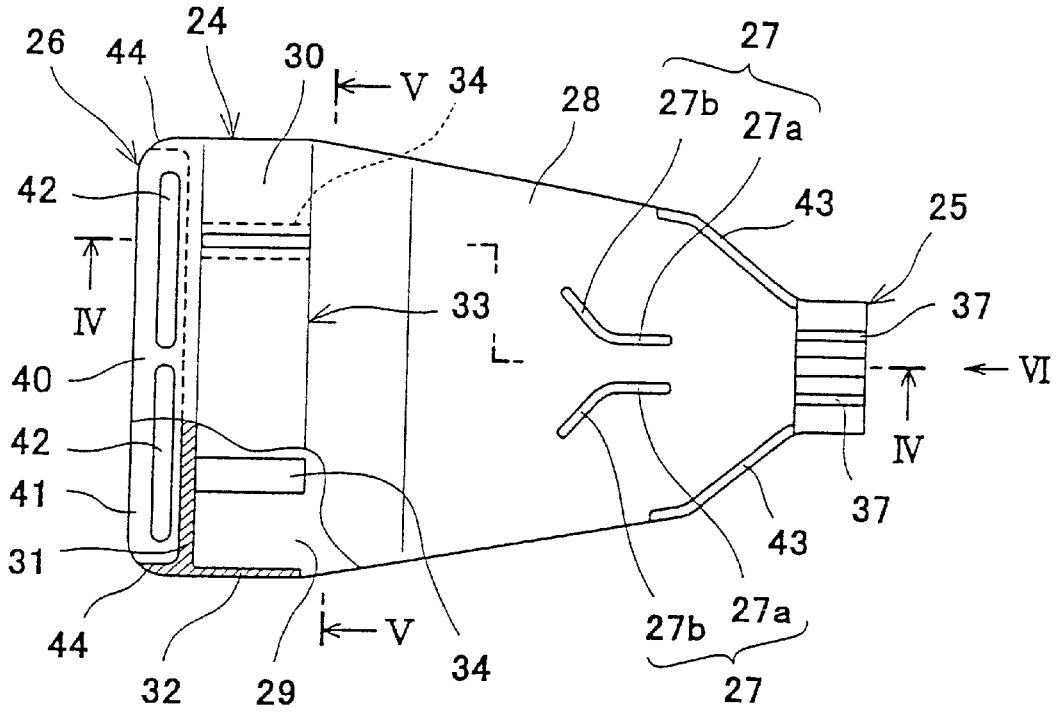
FIG. 3 is a partially broken plan view of the cutting blade cover of FIG. 1.
Figure 4:
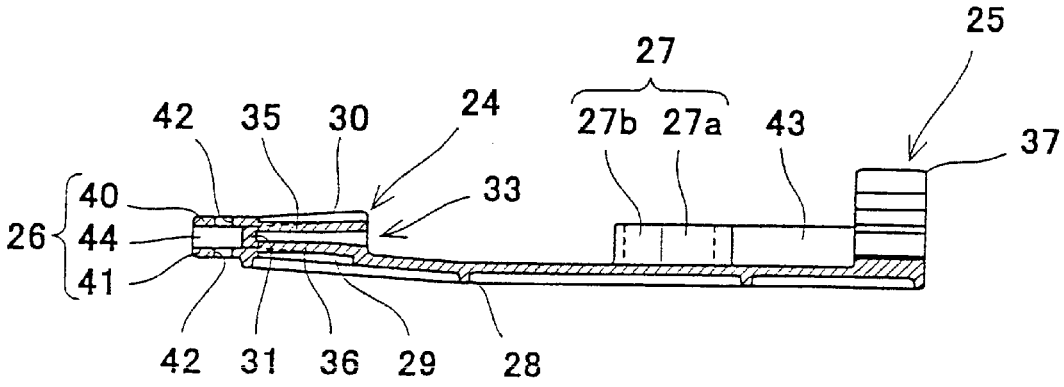
FIG. 4 is a cross-sectional view of the cutting blade cover of FIG. 3 taken along line IV—IV.
Figure 5:
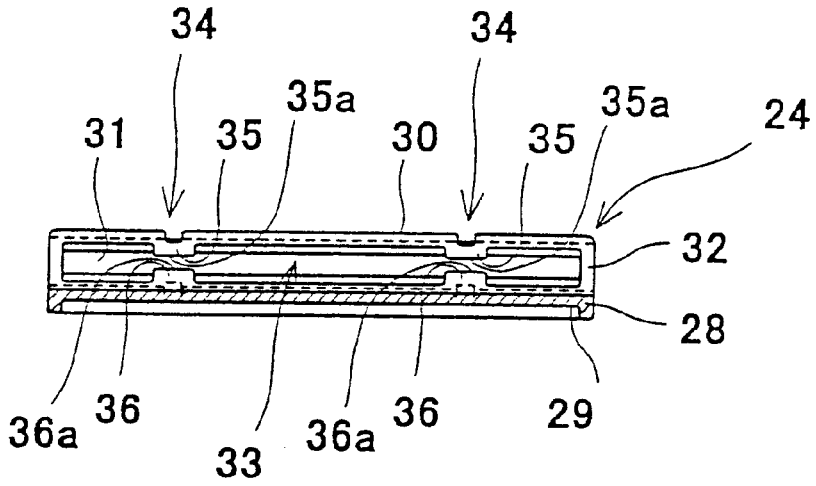
FIG. 5 is a cross-sectional view of the cutting blade cover of FIG. 3 taken along line V—V.
Figure 6:
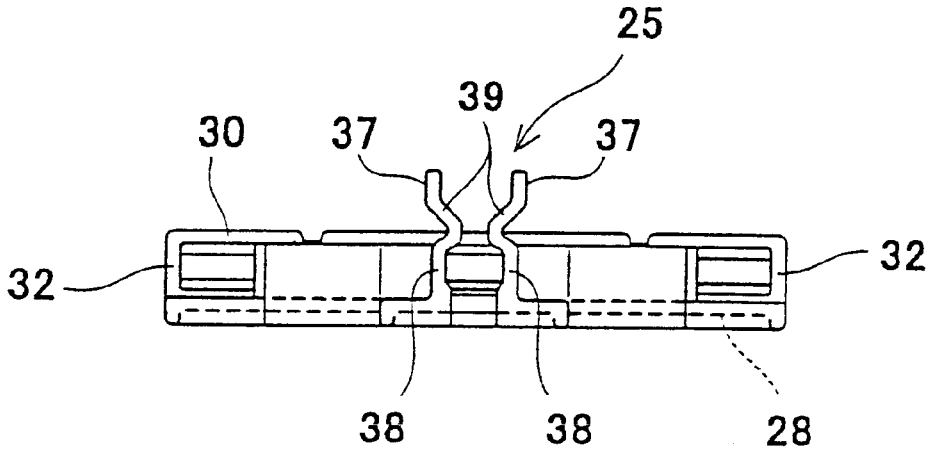
FIG. 6 is a view of the cutting blade cover of FIG. 3 when viewing in the direction of the arrow VI.
Figure 7:
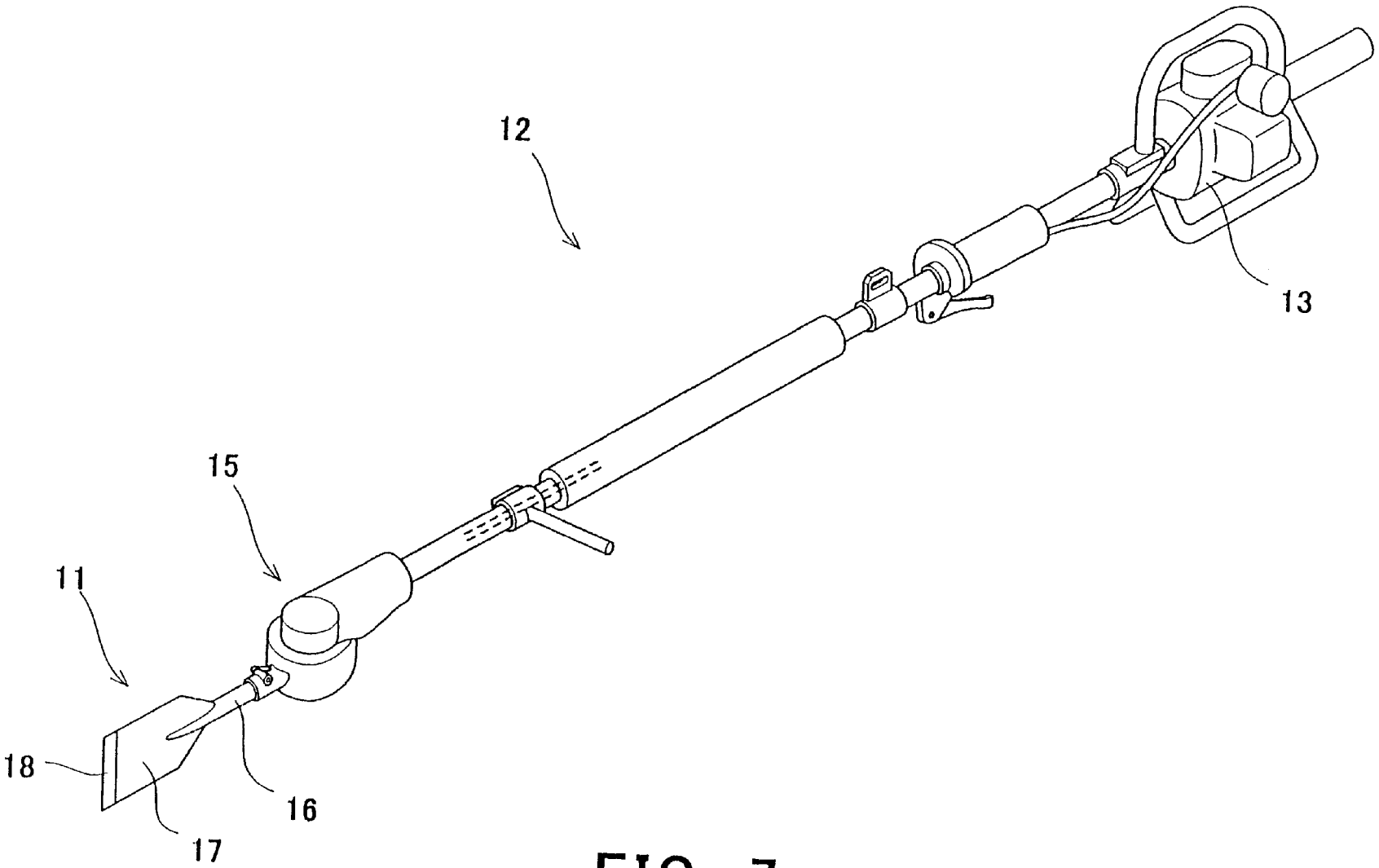
FIG. 7 is a perspective view showing a reaper to which the cutting blade cover of the present invention is applied.
Figure 8:
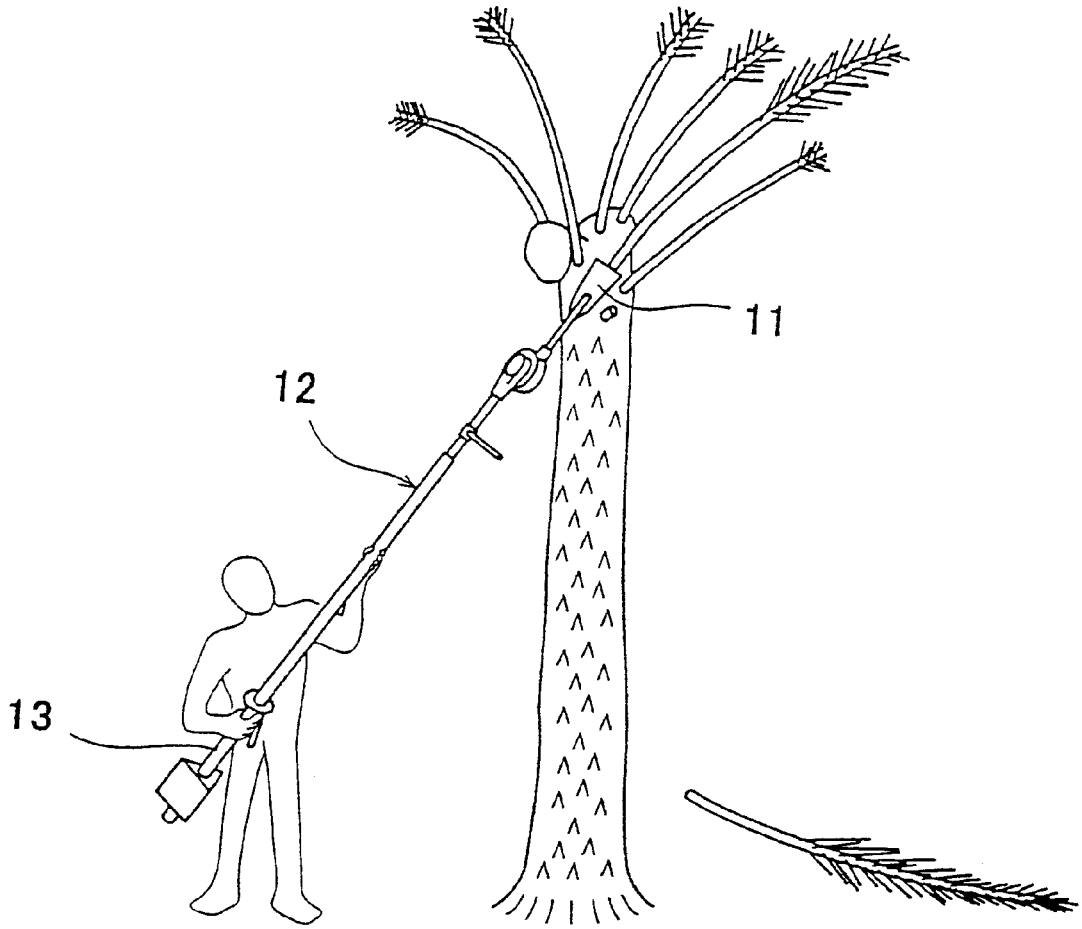
FIG. 8 is a schematic view showing how the reaper of FIG. 7 is used.
Figure 9:
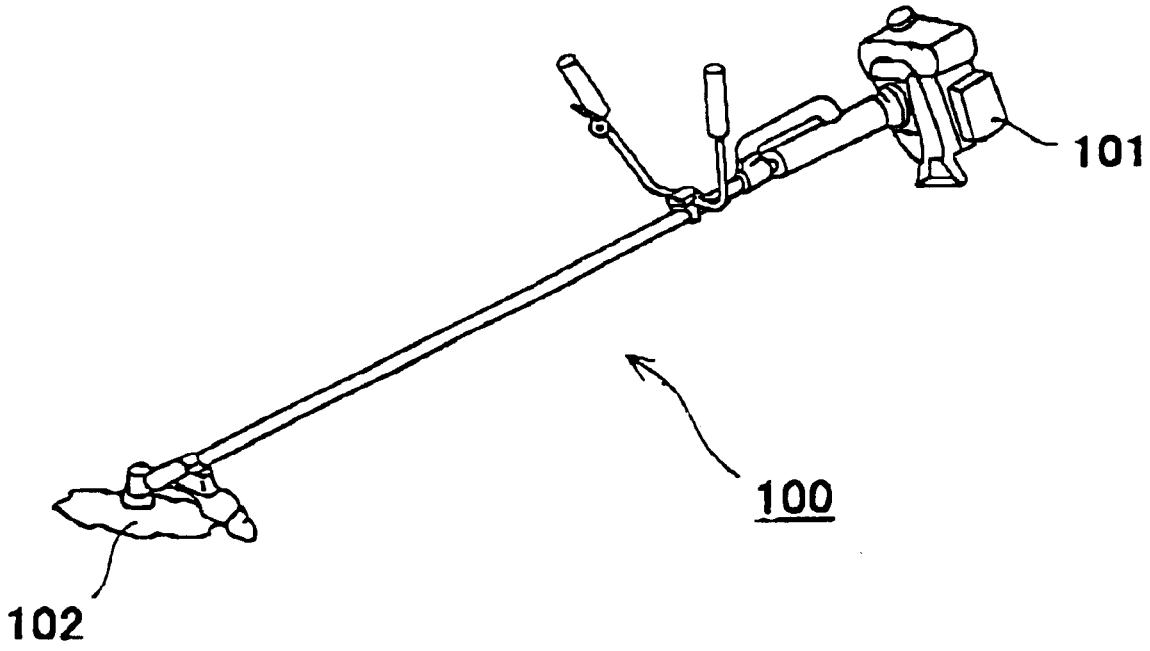
FIG. 9 is a perspective view showing a conventional brush cutter including a disc-shaped cutter.

FIG. 3 is a plan view showing a cross section of a part of the cutting blade cover 10. FIG. 4 is a cross-sectional view of the cutting blade cover 10 of FIG. 3 taken along line IV—IV. FIG. 5 is a cross-sectional view of the cutting blade cover 10 of FIG. 3 taken along line V—V. FIG. 6 is a view of the cutting blade cover 10 of FIG. 3 in the direction of the arrow VI. The detailed structure of the cutting blade cover 10 is described with reference to these Figures.

With reference to FIG. 3, the bag-shaped accommodating portion 24, the shank retaining portion 25, the elastic portion 26, the restricting plates 27, and the edge plates 43 are formed of synthetic resin integrally with the base plate portion 28.

The base plate portion 28 has a shape of a flat plate having a width gradually reduced from a tip end (from a portion where the bag-shaped accommodating portion 24 is provided) to a base end (toward the shank retaining portion 25). The reason why the base plate portion 28 has such a shape is that the shape of the base plate portion 28 is made to conform to the shape of the plate-shaped blade member 17. The shape of a peripheral portion of the base plate portion 28 when seen in a plan view is made larger than the shape of a peripheral portion of the plate-shaped blade member 17 of the cutting blade 11. Therefore, in a state in which the cutting blade cover 10 is attached to the cutting blade 11, as shown in FIG. 1, the cutting blade 11 is fully covered by the cutting blade cover 10. It should be noted that the shape of the base plate portion 28 is not limited to the above-described shape. The base plate portion 28 has a predetermined thickness so as to ensure required rigidity of the cutting blade cover 10.

The bag-shaped accommodating portion 24 is formed integrally with the base plate portion 28 at the tip thereof The bag-shaped accommodating portion 24 is constituted by a lower plate portion 29 as a part of the base plate portion 28, an upper plate portion 30 placed above the lower plate portion 29, a separating wall plate portion 31, and side wall plate portions 32. The bag-shaped accommodating portion 24 has a band-shaped space that is elongated in a width direction of the cutting blade cover 10, the space being closed by the upper plate portion 30 corresponding to an upper face, closed by the lower plate portion 29 corresponding to a lower face, closed by the separating wall plate portion 31 corresponding to a tip end face, closed by the side wall plate portions 32 corresponding to side faces, and opened toward the base end (shank side).

Specifically, the separating wall plate portion 31 is formed continuously with the upper plate portion 30 and the lower plate portion 29 such that a tip portion of the upper plate portion 30 and a tip portion of the lower plate portion 29 are connected. The side wall plate portions 32 connects the lower plate portion 29, the upper plate portion 30, and the separating wall plate portion 31. That is, the lower plate portion 29, the upper plate portion 30, the separating wall plate portion 31, and the side wall plate portions 32 constitute the bag-shaped accommodating portion 24 having an opening 33 through which the tip portion of the plate-shaped blade member 17 of the cutting blade 11 is inserted thereinto.

The bag-shaped accommodating portion 24 is provided with retaining portions 34 inside thereof. The retaining portions 34 serve to sandwich and securely retain the plate-shaped blade member 17 of the cutting blade 11 inserted through the opening 33 in a vertical direction. More specifically, each of the retaining portions 34 is constituted by a protrusion 35 protruded downward from the upper plate portion 30, and a protrusion 36 protruded upward from the lower plate portion 29. Each of these protrusions 35 and 36 has a shape of an elongated ridge from the opening 33 toward the separating wall plate portion 31. The protrusions 35 and 36 are inclined with each other so that a spacing between them becomes smaller toward the inside of the bag-shaped accommodating portion 24. While a pair of the retaining portions 34 are laterally symmetric in this embodiment, more retaining portions may be provided.

The shank retaining portion 25 is provided on an upper face of the base end portion of the base plate portion 28 and is of a so-called clip shape. Specifically, as shown in FIG. 6, the shank retaining portion 25 is constituted by a pair of walls 37 disposed opposite to each other and spaced from each other. Each of the walls 37 has an engaging portion 38 and a guide portion 39. The engaging portion 38 is protruded upward continuously with the base plate portion 28. Entrance portions of the engaging portions 38 are bent such that they are close to each other so as to retain the shank. The guide portions 39 are formed continuously with the engaging portions 38 and bent outward in such a manner that they are apart from each other from the entrance portions of the engaging portions 38 to allow the shank member 16 to be easily inserted between the engaging portions 38.

When the shank member 16 of the cutting blade 11 is pushed into the shank retaining portion 25 from above, each of the walls 37 is first elastically deformed outward and the shank member 16 is then sandwiched between the engaging portions 38 due to an elastic force of the walls 37 and retained therein. On the other hand, when the shank member 16 is taken out of the shank retaining portion 25, the walls 37 are elastically deformed outward so that the shank member 16 is extracted therefrom. While the shank retaining portion 25 is constituted by a pair of the walls 37 and is of a clip shape, the structure of the shank retaining portion 25 is not limited to this manner, and any structure may be adopted so long as the shank member 16 of the cutting blade 11 can be reliably retained and taken in and out.

The elastic portion 26 is formed continuously with the tip portion of the bag-shaped accommodating portion 24. The elastic portion 26 is constituted by an upper elastic plate 40, a lower elastic plate 41, and a connecting plate 44 connecting the upper elastic plate 40 and the lower elastic plate 41. A base end portion of the elastic portion 26 is closed by the separating wall plate portion 31 and a tip portion thereof is opened. The upper elastic plate 40 is continuous with an upper portion of the separating wall plate portion 31 of the bag-shaped accommodating portion 24 and the lower elastic plate 41 is continuous with a lower portion of the separating wall plate portion 31 of the bag-shaped accommodating portion 24. The upper elastic plate 40 and the lower elastic plate 41 are protruded from the bag-shaped accommodating portion 24 toward the tip such that they are parallel with each other.

More specifically, the elastic portion 26 has a space between the upper elastic plate 40 and the lower elastic plate 41. When an external force is applied to the elastic portion 26, the elastic portion 26 is elastically deformed. In this embodiment, as shown in FIG. 3, each of the upper elastic plate 40 and the lower elastic plate 41 has elongated holes 42 which make it easy for the elastic portion 26 to be deformed.

The restricting plates 27 are formed at a central portion of a region of the base plate portion 28, the region being closer to the base end than the bag-shaped accommodating portion 24. The restricting plates 27 are formed of plates and disposed on the base plate portion 28 such that they are protruded upward therefrom and are laterally symmetric. The restricting plates 27 are bent at the middle thereof so that they are flared toward the tip. Each of the restricting plates 27 is constituted by a support portion 27*a* for supporting the shank member 16 of the cutting blade 11 and a stopper 27*b* abutting with a rear end face of the plate-shaped blade member 17 so as to restrict axial movement of the cutting blade 11. The stoppers 27*b* are disposed such that a spacing between them is gradually reduced from the tip toward the base end. As shown in FIG. 1, the restricting plates 27 are bent so as to be adapted to the shape of a boundary portion between the rear portion of the plate-shaped blade member 17 and the shank member 16. Therefore, when the cutting blade 11 is moved to a right side in FIG. 1 from the state of FIG. 1, the stoppers 27*b* of the restricting plates 27 abut with the rear portion of the plate-shaped blade member 17 of the cutting blade 11.

Edge plates 43 are plate-shaped and laterally symmetric along the periphery of the base end portion of the base plate portion 28 where the shank retaining portion 25 is provided. The provision of the edge plates 43 further improves the rigidity of the base plate portion 28. In addition, the edge plates 43 provide the same effects as the restricting plates 27. Specifically, as shown in FIG. 1, when the cutting blade 11 is considerably smaller than the base plate portion 28, the restricting plates 27 are provided at positions adapted to the cutting member 11 that is small. In some cases, however, it is required that a cutting blade as large as the base plate portion 28 be used depending on the type of work, in which cases the edge plates 43 serve to prevent the play of the cutting blade. In other words, it is desirable to make the base plate portion 28 as large as the largest cutting blade to be used. When the edge plates 43 are used as the restricting plates, the restricting plates 27 are omitted. Further, the position or shape of the restricting plates is determined according to the size or shape of the cutting blade. The change of the position or shape of the restricting plates, or the omission of the same can be easily carried out by exchange of an insert die provided in a synthetic resin mold.

Subsequently, how the cutting blade cover 10 according to this embodiment is used will be explained.

The cutting blade cover 10 is attached to the cutting blade, when reaping operation of the reaper 12 is completed or interrupted and the reaper 12 is carried or stored. First, the plate-shaped blade member 17 of the cutting blade 11 is inserted into the bag-shaped accommodating portion 24 from the base end side of the cutting blade cover 10. Since the bag-shaped accommodating portion 24 has a bag shape formed of the upper plate portion 30, the lower plate portion 29, the separating wall plate portion 31, and the side wall plate portions 32, the bag-shaped accommodating portion 24 can protect the cutting portion 18 with the tip portion of the plate-shaped blade member 17 accommodated. In this state, the shank member 16 of the cutting blade 11 is pushed into the engaging portions 38 through the guide portions 39 of the shank retaining portion 25 to thereby fix the cutting blade cover 10 to the cutting blade 11. Thereby the cutting blade cover 10 is easily attached to the cutting blade 11. When the cutting blade cover 10 is attached to the cutting blade 11, the shank member 16 is pulled out of the engaging portions 38 toward the guide portions 39 and the plate-shaped blade member 17 is then extracted from the bag-shaped accommodating portion 24, whereby the cutting blade cover 10 is detached from the cutting blade 11.

Thus, in accordance with the cutting blade cover 10 according to this embodiment, the cutting blade cover 10 can be easily attached to the cutting blade 11 by the simple operation, that is, by inserting the plate-shaped blade member 17 of the cutting blade 11 into the bag-shaped accommodating portion 24 and making the shank retaining portion 25 retain the shank member 16, and the cutting blade 11 can be reliably retained by the restricting plates 27, the top portions 35*a* and 36*a* of the protrusions 35 and 36 of the bag-shaped accommodating portion 24, and the engaging portions 38 of the shank retaining portion 25. Further, it is preferable that the cutting blade 11 is elastically retained by the support portions 27*a* of the restricting plates 27, the top portions 35*a* and 36*a* of the protrusions 35 and 36, and the shank retaining portion 25. Moreover, by detaching the shank member 16 from the shank retaining portion 25 and extracting the plate-shaped blade member 17 from the bag-shaped accommodating portion 24, the cutting blade cover 10 can be easily detached from the cutting blade 11. As a result, when the reaping work is started or completed, the cutting blade cover 10 can be easily attached or detached in a very short time.

In the cutting blade cover 10 according to this embodiment, since the elastic portion 26 is formed continuously with the tip portion of the bag-shaped accommodating portion 24, damage to the cutting blade 11 caused by the external force applied to the bag-shaped accommodating portion 24 can be avoided because of the elastic deformation of the elastic portion 26.

Furthermore, since the restricting plates 27 are provided, displacement of the cutting blade 11 from the cutting blade cover 10, is restricted by the fact that the restricting plates 27 abut with the boundary portion between the shank member 16 and the plate-shaped blade member 17 of the cutting blade 11. Thereby, the detachment of the cutting blade cover 10 can be avoided and the cutting blade 11 can be reliably protected.

Moreover, the retaining portions 34 in the bag-shaped accommodating portion 24 can sandwich the cutting portion 18 of the cutting blade 11 without vertical play with the cutting portion 18 accommodated in the bag-shaped accommodating portion 24. Thereby, detachment of the cutting blade cover 10 or the like can be avoided and the cutting blade 11 can be reliably protected. In particular, in the cutting blade cover 10 according to this embodiment, the elongated ridge-shaped protrusions 35 and 36 constitute the retaining portions 34 for sandwiching the cutting blade 11, and therefore, the bag-shaped accommodating portion can be easily fabricated.

Furthermore, because the cutting blade cover 10 can be integrally formed of synthetic resin, the cutting blade cover 10 is fabricated at a low cost. It should be noted that a portion of the cutting blade cover 10 may be formed as a separate portion and connected to the other portion by means of bolts or adhesion as necessary. For example, the bag-shaped accommodating portion 24 and the like may be fabricated as separate parts and assembled into the cutting blade cover 10 in a different step.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A cutting blade cover for protecting a cutting blade having a shank member connected to a driving unit of a reaper and a plate-shaped blade member formed continuously with the shank member and provided with a cutting portion at a tip portion thereof that is orthogonal to the shank member, comprising:

a bag-shaped accommodating portion for accommodating the cutting portion provided at the tip portion of the plate-shaped blade member;

a shank retaining portion for retaining the shank member;

a first displacement restricting portion provided between the bag-shaped accommodating portion and the shank retaining portion to restrict displacement of the cutting blade from the bag-shaped accommodating portion; and a base plate portion covering a side surface of the plate-shaped blade member; and the bag-shaped accommodating portion, the shank retaining portion, and the first displacement restricting portion being formed integrally with the base portion.

2. The cutting blade cover of claim 1 further comprising:

an elastic portion formed in a tip portion of the bag-shaped accommodating portion such that the elastic portion extends forwardly from a separating wall portion provided as corresponding to a tip portion of the cutting blade in the bag-shaped accommodating portion and is comprised of an elastic plate so as to have a hollow portion inside thereof.

3. The cutting blade cover of claim 1, further comprising:

an edge portion provided along a periphery of the base plate portion so as to extend along a periphery of the base plate portion from the shank retaining portion toward a tip end of the base plate portion.

4. The cutting blade cover of claim 1:

wherein the bag-shaped accommodating portion, the shank retaining portion, and the first displacement restricting portion are molded in one piece with the base plate portion by synthetic resin.

5. The cutting blade cover of claim 1, wherein:

the bag-shaped accommodating portion includes a ridge-shaped retaining portion extending in a direction of the shank, for sandwiching and securely retaining a tip portion of the cutting blade with the cutting portion of the cutting blade accommodated in the bag-shaped accommodating portion.

6. The cutting blade cover of claim 4, further comprising an edge portion provided along a periphery of the base plate portions as to extend along a periphery of the base plate portion from the shank retaining portion toward a tip end of the base plate portion wherein the edge portion is molded in one piece with the base plate portion by synthetic resin.

7. The cutting blade cover of claim 1, wherein the first displacement restricting portion is comprised of a stopper provided along a rear end face of the plate shaped blade member so as to make contact with the rear end face and a concave support portion for supporting a side of the shank member so as to restrict lateral displacement of the cutting blade.

8. The cutting blade cover of claim 7, wherein the first displacement restricting portion is plate-shaped and is protruded from the base plate portion.

9. The cutting blade cover of claim 8, wherein the first displacement restricting portion is provided as to extend along a periphery of the base plate portion from the shank retaining portion toward a tip end of the base plate portion.

10. The cutting blade cover of claim 4 wherein:

said bag-shaped accommodating portion includes a plurality of ridge-shaped retaining portions extending in a direction of the shank, for sandwiching and securely retaining a tip portion of the cutting blade with the cutting portion of the cutting blade accommodated in the bag-shaped accommodating portion.

* * * * *